United States Patent [19]

Larsen

[11] Patent Number: 4,797,659

[45] Date of Patent: Jan. 10, 1989

[54] METHOD AND A UNIT FOR SYNCHRONIZING BURGLARY DETECTORS

[75] Inventor: Stig K. Larsen, Roskilde

[73] Assignee: Anton Security Denmark A/S, Roskilde, Denmark

[21] Appl. No.: 1,698

[22] Filed: Jan. 9, 1987

[30] Foreign Application Priority Data

Jan. 27, 1986 [DK] Denmark ..... 395/86

[51] Int. Cl.[4] ..... G08B 13/24

[52] U.S. Cl. ..... 340/572; 340/551

[58] Field of Search ..... 340/572, 551

[56] References Cited

U.S. PATENT DOCUMENTS 4,658,241 4/1987 Torre ..... 340/572

4,667,185 5/1987 Nourse et al. ..... 340/572

FOREIGN PATENT DOCUMENTS 133500 9/1983 European Pat. Off. .

*Primary Examiner*—Glen R. Swann, III

*Attorney, Agent, or Firm*—Ladas & Parry

[57] ABSTRACT

A method and a unit synchronizes a system for detecting passage of an article through a predetermined area to the mains power wave thereto. The system has a transmitter and a receiver alternately transmitting and receiving electro-magnetic signals as well as a marker secured to the article for receiving said signal and transmitting other signals during article passage of the area. In this manner, undesired interference with a neighboring, like system is avoided, without the interconnection therebetween, because the existing mains network is employed for the synchronizing.

7 Claims, 2 Drawing Sheets

METHOD AND A UNIT FOR SYNCHRONIZING BURGLARY DETECTORS

FIELD OF THE INVENTION

The invention relates to a method of synchronizing each of a number of systems for detecting passage of an article through a predetermined area, each system comprising a transmitter and a receiver alternately transmitting and receiving electro-magnetic signals as well as a marker secured to the article for receiving said signals and transmitting other signals during the passage of the article through the area, and a unit therefor.

Background Art

International patent application No. 84/04191 and international patent application No. 83/03203 deal with burglary alarms to be situated in several different stores. When these stores are situated close to one another, it is of importance that the systems are synchronized in such a manner that one system is not transmitting simultaneously with the receiving of another system. It is known to avoid this by synchronizing the systems with a cable connection between the systems, in which case one of the systems operates as a master while the remaining systems operate as "slaves".

SUMMARY OF THE INVENTION

Interest has arisen in avoiding these cable connections and, according to the invention, has been achieved by synchronizing a system directly from the conductors of the power mains thereto. In this manner, such systems need not be otherwise, e.g. cable, interconnected, due to the employment of the existing conductors of the mains.

It turns out, however, that synchronizing to the mains network causes some technical problems. A unit for mains synchronizing a system detecting a passage of an article through a predetermined area, wherein the system comprises a transmitter and a receiver alternately transmitting and receiving electro-magnetic signals, a marker secured to the article which receives said transmitted signals and transmits other signals during the passage of the article through the area, and a galvanic separation of the transmitter and receiver from the mains in the form of a transformer, is therefore characterized, according to the invention, by synchronizing the secondary side of the transformer from the primary side thereof, and by providing an additional galvanic separation in the synchronizing unit. In this manner, the desired synchronizing is obtained and the galvanic separation is maintained.

The synchronizing may for instance be carried out by means of a comparator detecting zero crossings on the primary side. The additional galvanic separation may for instance be an opto-coupler.

BRIEF DESCRIPTION OF DRAWINGS

The invention will be described in more detail below with reference to the accompanying drawing, in which FIG. 1 schematically illustrates a unit for synchronizing a system to the mains, and FIG. 2 schematically illustrates the system.

PREFERRED EMBODIMENT OF THE INVENTION

According to the invention, a burglary-alarm system is synchronized to the mains thereto. In this manner, other interconnection between such systems is avoided. It is not easy to provide such synchronization, however, because the mains have a short periodic time of, for example, 20 msec. at 50 Hz while the pulse width for each synchronizing detection should be about 2 msec. The synchronizing must therefore occur with an accuracy of about ⅔ msec. A galvanicseparation transformer at T1 (FIG. 1) is between the mains and the burglary alarm system (FIG. 2). Such a transformer T1 distorts the power wave from its mains (220VAC)-connected primary (winding) 1 in its secondary (winding) to such a degree that synchronization based on the zero crossing of the power wave in the secondary is, therefore, impossible. This technical problem is solved, according to the invention, by synchronizing the secondary voltage relative to the primary voltage, i.e. the voltage of the mains. In doing this, however, the galvanic separation originally provided by the transformer at T1 is lost and an additional galvanic separation is therefore introduced into the synchronizing unit of the invention.

The synchronizing of the synchronizing unit is carried out by a comparator in the form of an operational amplifier U101 having at least one input 3 communicating with the voltage of the mains by connection thereto, in this case through a resistor R1. The additional galvanic separation is established by an opto-coupler 4 comprising a light diode 5 connected to the output of the operational amplifier U101.

Figure 1:
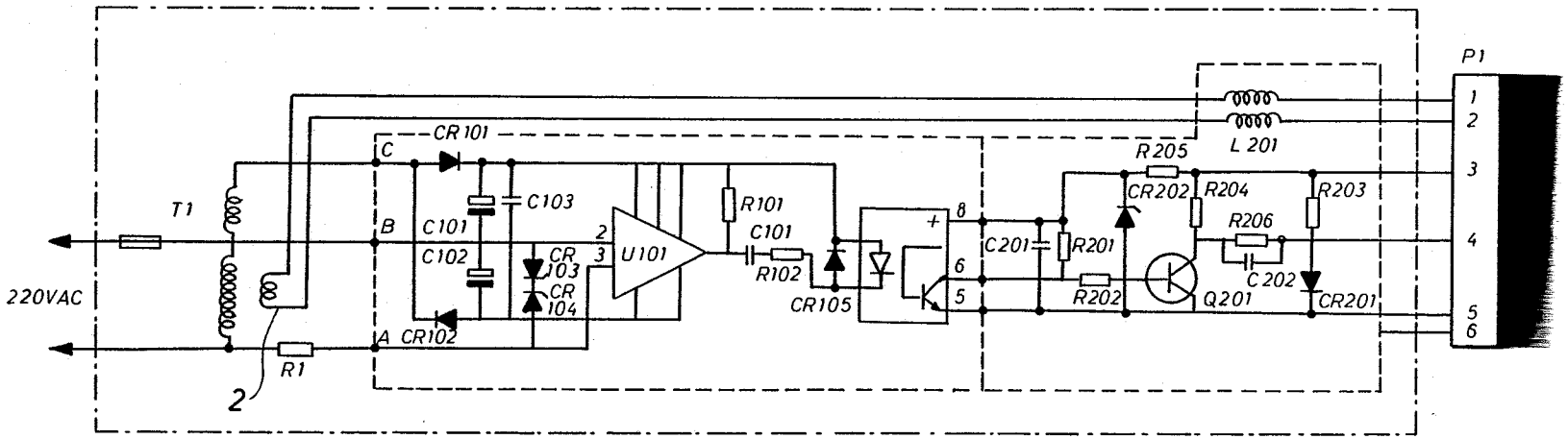
Figure 2:
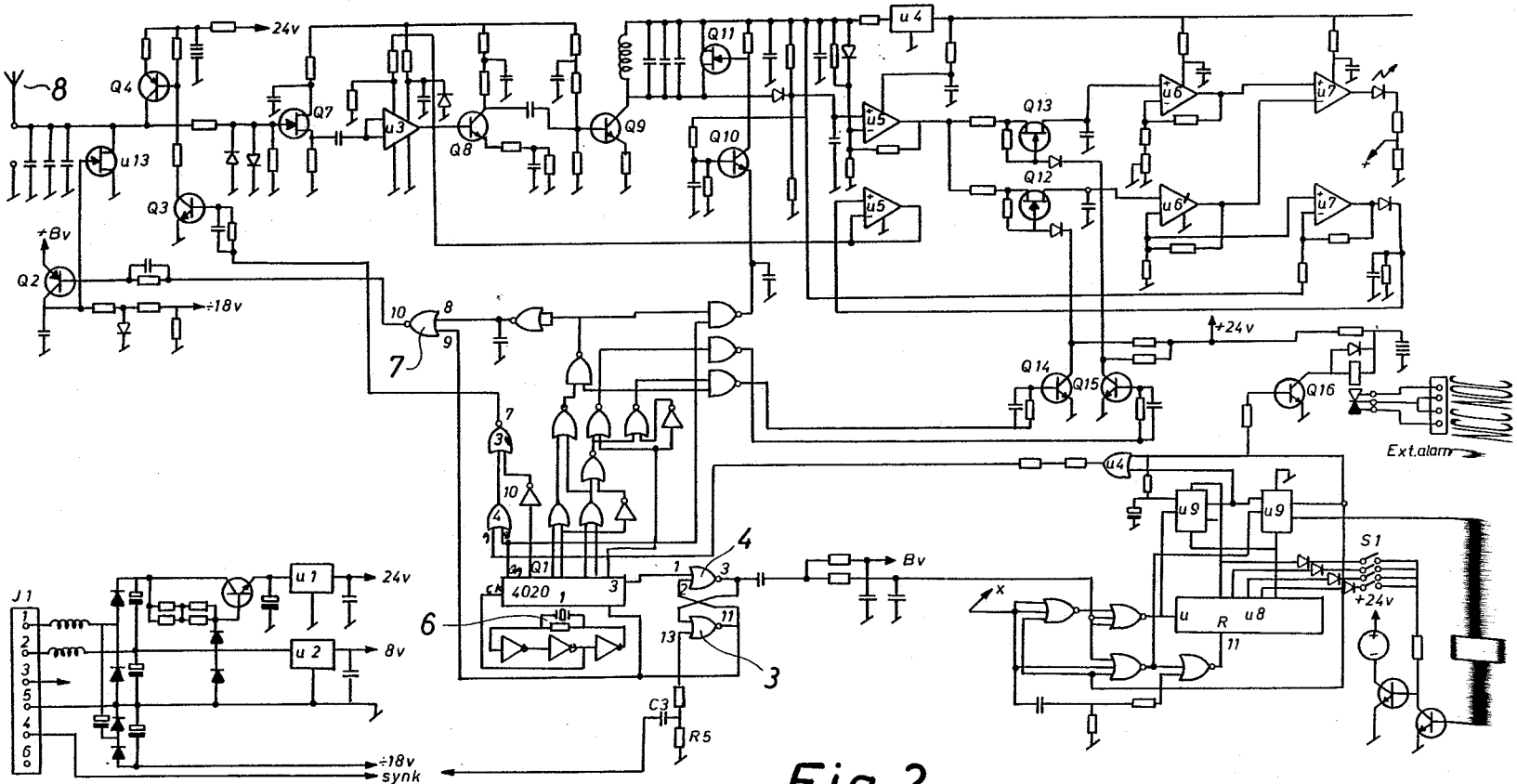

Energy for the system (FIG. 2) and remainder of the synchronizing unit (FIG. 2) is provided from the secondary winding 2 of the transformer T1 (FIG. 1).

More specifically, the primary voltage of the transformer T1, i.e. the voltage of the mains, is rectified by diode CR 101, CR 102 and transferred to the comparator U101 operating as a zero crossing detector for the voltage of the mains. The rectified voltage is smoothed by electrolytic capacitors C101 and C102 and a parallel capacitor C103 short-circuits possible HF-signals and transients. A shock absorber comprising two oppositely-coupled zener diodes CR 103, CR 104 protects the input of the comparator U101 against too high voltages. The comparator U101 therefore delivers a pulsating voltage at the mains frequency, in this case, 50 Hz. This pulsating voltage is transmitted to the primary side of the opto-coupler 4 through an RC integration circuit at 105. The opto-coupler 4 delivers a corresponding, 50 Hz signal at terminal 6, and this signal is transmitted to the base of a transistor Q201 through a voltage divider R201, R202. The collector of the transistor is connected to a parallel coupling of a resistor R205 and a capacitor C202. When terminal 6 of the opto-coupler 4 is positive and exceeds a voltage of about 0.6V, the transistor Q201 becomes conductive and a signal is transmitted through R205, C202 to terminal P4 of a connector P having terminals P1 to P6. The resulting pulses at terminal P4 are used as synchronizing pulses for the control of the burglary alarm.

As shown in FIG. 2, voltage regulators U1 and U2 producing 24V and 8V, respectively, are provided in connection with the separate secondary winding 2 of the transformer at T1 via terminals P1, P2. Via an integration circuit C3, R5, the synchronizing pulses are transmitted to a latch comprising two NOR-gates 30, 40. The positive pulses are transmitted to terminal 13 of the lower NOR-gate 30. A signal is only transmitted from this NOR-gate 30 at the presence of zero value at the upper NOR-gate 40, and such value is present when a cyclic counter 4020 connected thereto has been zeroed. The positive pulse on terminal 13 makes the output 11 of the lower NOR-gate 30 negative, and this negative pulse activates the entire system as the counter 4020 leaves zero. For this, the counter counts the pulses from a crystal-controlled oscillator 16 oscillating at a frequency of 2.125 MHz.

The negative pulse from the output 11 of NOR-gate 30 is transmitted to terminal 9 of NOR-gate 7. Nothing happens in NOR-gate until this pulse leaves terminal 9, but the counting in counter 4020 continues to cause it to discontinue the pulse and, thereafter, a signal from output Q1 of the counter 4020 provides a control pulse to an HF-transmitter Q4. The transmitter Q4 then produces an HF signal from a frame aerial 8 for a marker on an article, if in the area of the HF signal from the antenna, i.e. being burgled, the marker being known and, therefore, not shown. If the marker receives the HF signal, it transmits another signal for a receiver and a sample/hold circuit in the system (FIG. 2). Because the output Q9 of the counter 4020 NOR-gate 7 is now high, a negative pulse of 1.88 μsec. is produced and this pulse grounds the frame aerial 8 for a short period which opens the receiver. After 15 microseconds, other outputs of the counter 4020 provide a signal to open a sample circuit at FET Q13, which opens a noise sample circuit at FET P12. An AGC-adjustment is provided in connection with the noise sample circuit. The signal from the noise sample circuit at Q12 is fed to a comparator U6'. The output of the comparator U6' is transferred to the inverting input terminal of another comparator U7 in order to be compared with the signal sampling from the sample circuit. When the signal sampling exceeds the noise sampling from the noise sampling circuit at FET Q12, a trigger pulse is transmitted to a second cycling counter U8 (in the lower right corner of FIG. 2) through a terminal x. If sixteen such pulses follow, i.e., if the signal sampling exceeds the noise sampling for a further sixteen periods (about 320 msec.), the alarm is activated.

The counter 4020, thus determines when the frame aerial 8 is transmitting or receiving and when a signal sampling and noise sampling is to be carried out, the latter by transistors Q14, Q15, every 1.92 μsec. as determined by the crystal 16. Consequently, the crystal 16 determines when the entire system is to be closed. As the time interval is approx. 2 msec. it does not matter how the three mains phases are situated relative to one another. Furthermore it does not matter whether the mains frequency is 50 or 60 Hz.

I claim:

1. In a system for detecting passage of a marker on an article through an area, the system comprising transmitter and receiver means for alternately transmitting a signal and receiving another, responsive signal from the marker, if in the area during the transmitting, an improved synchronization method, comprising:

providing with a transformer a galvanic separation between the transmitter and receiver means and power mains therefor, said power mains having a power wave; and synchronizing the transmitter and receiver means directly to the power wave of the power mains, whereby adjacent systems may be synchronized to each other without other, cable connection therebetween or distortion from the transformer.

2. In a system for detecting passage of a marker on an article through an area, the system comprising transmitter and receiver means for alternately transmitting a signal and receiving another, responsive signal from the marker, if in the area during the transmitting, an improved synchronization unit, comprising:

a transformer having a primary for connection to power mains, the power mains having a power wave, and a secondary responsive to the primary for driving the transmitter and receiver means; and synchronizing means for synchronizing the transmitter and receiver means directly to the power wave of the power mains.

3. The system of claim 2, wherein the synchronizing means comprises a comparator for detecting zero crossings in the power wave.

4. The system of claim 3, and further comprising additional galvanic-separation means other than the transformer for connecting the synchronizing means to the power mains.

5. The system of claim 4, wherein the additional galvanic separation means is an opto-coupler.

6. The system of claim 2, and further comprising additional galvanic-separation means other than the transformer for connecting the synchronizing means to the power mains.

7. The system of claim 6, wherein the additional galvanic separation means is an opto-coupler

* * * * *